US010780453B2

(12) United States Patent
Ries

(10) Patent No.: US 10,780,453 B2
(45) Date of Patent: Sep. 22, 2020

(54) ELONGATED PAINTING APPARATUS

(71) Applicant: JVIS-USA, LLC, Shelby Parkway, MI (US)

(72) Inventor: Susan Ries, Burnsville, MN (US)

(73) Assignee: JVIS-USA, LLC, Shelby Township, MI (US)

( * ) Notice: Subject to any disclaimer, the term of this patent is extended or adjusted under 35 U.S.C. 154(b) by 59 days.

(21) Appl. No.: 15/972,926

(22) Filed: May 7, 2018

(65) Prior Publication Data

US 2018/0353989 A1 Dec. 13, 2018

Related U.S. Application Data

(60) Provisional application No. 62/518,153, filed on Jun. 12, 2017.

(51) Int. Cl.
*B05C 17/00* (2006.01)
*B05C 17/02* (2006.01)
(Continued)

(52) U.S. Cl.
CPC ..... *B05C 17/00* (2013.01); *A46B 7/04* (2013.01); *A46B 9/005* (2013.01); *B05C 17/02* (2013.01); *A46B 2200/202* (2013.01)

(58) Field of Classification Search
CPC ..... B05C 17/00; B05C 17/10; B05C 1/06
See application file for complete search history.

(56) References Cited

U.S. PATENT DOCUMENTS

D190,067 S 4/1961 Reedy
3,193,863 A 7/1965 Myers
(Continued)

FOREIGN PATENT DOCUMENTS

CA 2111262 A1 6/1995
EP 0872311 A2 10/1998
(Continued)

OTHER PUBLICATIONS

How to Paint Behind the Toilet: Introducing the Paint Behind' (Paint Behind) Feb. 11, 2016 (Feb. 11, 2016) [online] retrieved from <URL: https://www.youtube.com/watch?v=Jq4nUvNjHDw> entire document, especially demonstration 0:40-0:49, 1:25-1:33, 1:38-1:50, 1:56-2:00, 2:13-2:21.
(Continued)

*Primary Examiner* — Michael D Jennings
(74) *Attorney, Agent, or Firm* — Moss & Barnett; Michael A. Bondi

(57) ABSTRACT

An elongated painting apparatus including a paint applicator holder, a paint applicator and a lock mechanism. The paint applicator holder has a handle portion and an applicator portion that extends from a distal end of the handle portion. The paint applicator is detachably engagable with the applicator portion. The lock mechanism has a first engagement structure, a second engagement structure and an opening. The first engagement structure and the second engagement structure are provided in one of the applicator portion and the paint applicator. The opening is formed in one of the applicator portion and the paint applicator where the first engagement structure and the second engagement structure are not located. The first engagement structure and the second engagement structure are selectively received in the opening to retain the paint applicator in a first position or a second position with respect to the paint applicator holder.

15 Claims, 4 Drawing Sheets

(51) Int. Cl.
*A46B 9/00* (2006.01)
*A46B 7/04* (2006.01)

(56) References Cited

U.S. PATENT DOCUMENTS

| | | | | |
|---|---|---|---|---|
| 3,366,988 | A * | 2/1968 | Ginter | A46B 15/00 15/244.1 |
| 3,389,418 | A * | 6/1968 | Sencabaugh | A61H 7/003 15/244.1 |
| 3,402,417 | A * | 9/1968 | Lund | B05C 17/00 15/244.1 |
| 3,821,829 | A | 7/1974 | Finnerty | |
| 4,155,139 | A | 5/1979 | Corcoran | |
| D299,558 | S | 1/1989 | Robison | |
| 4,856,136 | A | 8/1989 | Janssen | |
| D332,153 | S | 12/1992 | Butler | |
| D344,814 | S | 3/1994 | Fath | |
| 5,341,538 | A | 8/1994 | Banome | |
| 5,692,261 | A | 12/1997 | Lops | |
| 5,774,925 | A | 7/1998 | Pryor, III | |
| D425,659 | S | 5/2000 | Larocque | |
| 6,295,685 | B1 | 10/2001 | Douglas | |
| 6,415,470 | B1 | 7/2002 | Ramrattan | |
| 6,438,787 | B1 | 8/2002 | Young | |
| 7,073,935 | B2 | 7/2006 | Liem | |
| 7,076,826 | B2 * | 7/2006 | Hochanadel | B05C 17/00 15/143.1 |
| D617,944 | S | 6/2010 | Gonzalez | |
| D636,121 | S | 4/2011 | Shuch | |
| 9,180,479 | B1 * | 11/2015 | Ries | A46B 1/00 |
| 10,166,569 | B1 * | 1/2019 | Ries | B05C 17/00 |
| 2004/0158950 | A1 * | 8/2004 | Hochanadel | B05C 17/00 15/244.1 |
| 2006/0000042 | A1 * | 1/2006 | Rekart | A46B 7/04 15/160 |
| 2006/0075592 | A1 | 4/2006 | Sommers | |
| 2006/0248669 | A1 | 11/2006 | Dovellos | |
| 2007/0157408 | A1 | 7/2007 | Bargiel | |
| 2010/0173091 | A1 * | 7/2010 | Reis | B05C 17/00 427/429 |

FOREIGN PATENT DOCUMENTS

| | | | |
|---|---|---|---|
| GB | 1230983 | A | 5/1971 |
| GB | 2090730 | A | 7/1982 |
| WO | 8603461 | A1 | 6/1986 |
| WO | 9832540 | A1 | 7/1998 |

OTHER PUBLICATIONS

International Search Report and Written Opinion received for Serial No. PCT/US2018/031603, 11 pgs.

* cited by examiner

ELONGATED PAINTING APPARATUS

REFERENCE TO RELATED APPLICATION

This application claims priority to Provisional Applic. No. 62/518,153, filed on Jun. 12, 2017, the contents of which are incorporated herein by reference.

FIELD OF THE INVENTION

The present invention generally relates to paint application devices. More particularly, the invention relates to a painting apparatus and method of use in connection with painting within narrow spaces.

BACKGROUND OF THE INVENTION

In certain situations it is desirable to mount objects close to surfaces to minimize the portion of the location in which the object is located that is occupied by the object. An example of one such object is a toilet. It is possible to mount the toilet close to a wall because it is generally not necessary to access the portion of the wall that is behind the toilet.

One of the primary times that it is necessary to access the space behind the toilet is when decorating. For example, it is generally desirable to paint the space behind the toilet when painting other portions of the wall that are not behind the toilet.

While conventional painting implements such as rollers and paint brushes may be used on the other portions of the wall that are not behind the toilet, the toilet is typically located sufficiently close to the wall such that it is not possible to access all of the space that is behind the toilet with a conventional roller or paint brush.

To overcome this limitation, it is common to disconnect at least a portion of the toilet to facilitate painting behind the toilet. A problem with disconnecting a portion of the toilet is that it may be necessary to have the portion of the toilet disconnected by a plumber because the toilet contains water and drain lines. Any water and/or waste that inadvertently escapes from the toilet may not only cause damage to the areas that surround the toilet, but also could present a health risk.

A need exists for improvement in paint application devices. This need, and other needs, is addressed by one or more aspects of the present invention.

SUMMARY OF THE INVENTION

An embodiment of the invention is directed to an elongated painting apparatus that includes a paint applicator holder, a paint applicator and a lock mechanism. The paint applicator holder has a handle portion and an applicator portion that extends from a distal end of the handle portion. The paint applicator is detachably engagable with the applicator portion. The lock mechanism has a first engagement structure, a second engagement structure and an opening. The first engagement structure and the second engagement structure are provided in one of the applicator portion and the paint applicator. The opening is formed in one of the applicator portion and the paint applicator where the first engagement structure and the second engagement structure are not located. The first engagement structure and the second engagement structure are selectively received in the opening to retain the paint applicator in a first position or a second position with respect to the paint applicator holder.

Another embodiment of the invention is directed to an elongated painting apparatus that includes a paint applicator holder, a paint applicator and a lock mechanism. The paint applicator holder has a handle portion and an applicator portion that extends from a distal end of the handle portion. The paint applicator is detachably engagable with the applicator portion. The lock mechanism has an engagement structure, a first opening and a second opening. The engagement structure is provided in one of the applicator portion and the paint applicator. The first opening and the second opening are formed in one of the applicator portion and the paint applicator where the engagement structure is not located. The engagement structure is selectively received in either the first opening or the second opening to retain the paint applicator in a first position or a second position with respect to the paint applicator holder.

Another embodiment of the invention is directed to a method of painting a surface having an object in close proximity thereto. An elongated painting apparatus is provided that includes a paint applicator holder, a paint applicator and a lock mechanism. The paint applicator holder has a handle portion and an applicator portion that extends from a distal end of the handle portion. The lock mechanism has a first engagement structure, a second engagement structure and an opening. The first engagement structure and the second engagement structure are provided in one of the applicator portion and the paint applicator. The opening is formed in one of the applicator portion and the paint applicator where the first engagement structure and the second engagement structure are not located. The paint applicator is positioned in a first position with respect to the paint applicator holder where the first engagement structure is at least partially received in the opening. The elongated painting apparatus has a first length when the paint applicator is in the first position. The paint applicator is moved to a second position with respect to the paint applicator holder where the second engagement structure is at least partially received in the opening. The elongated painting apparatus has a second length when the paint applicator is in the second position. The first length is smaller than the second length.

BRIEF DESCRIPTION OF THE DRAWINGS

The accompanying drawings are included to provide a further understanding of embodiments and are incorporated in and constitute a part of this specification. The drawings illustrate embodiments and together with the description serve to explain principles of embodiments. Other embodiments and many of the intended advantages of embodiments will be readily appreciated as they become better understood by reference to the following detailed description. The elements of the drawings are not necessarily to scale relative to each other. Like reference numerals designate corresponding similar parts.

DETAILED DESCRIPTION OF THE INVENTION

Figure 1:
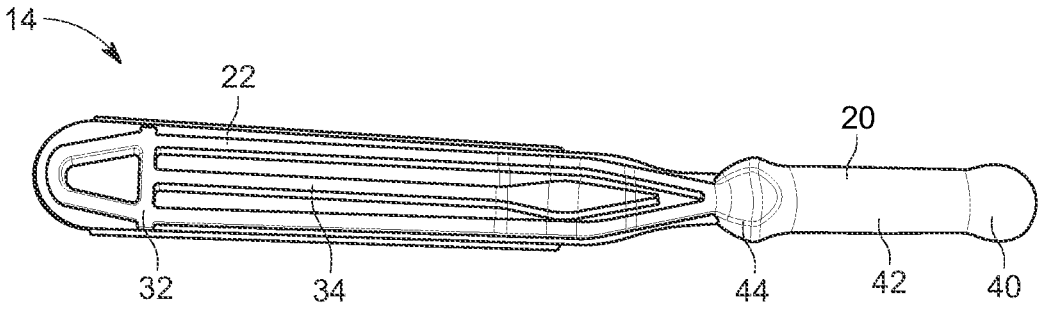
FIG. 1 is a top view of a handle portion of the elongated painting apparatus according to an embodiment of the invention.

An embodiment of an elongated painting apparatus 10 according to an embodiment of the present invention is illustrated in the drawings submitted herewith. The painting apparatus 10 aids in the application of paint to surfaces that are blocked or obstructed by objects placed close to the surfaces, such as toilets, stoves and refrigerators. Many such objects are very heavy or permanently mounted, and therefore difficult or impossible to move.

Figure 2:
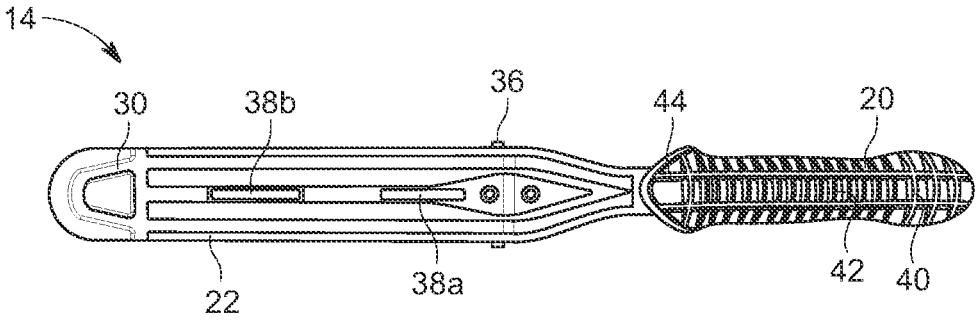
FIG. 2 is a bottom view of the handle portion.
Figure 3:
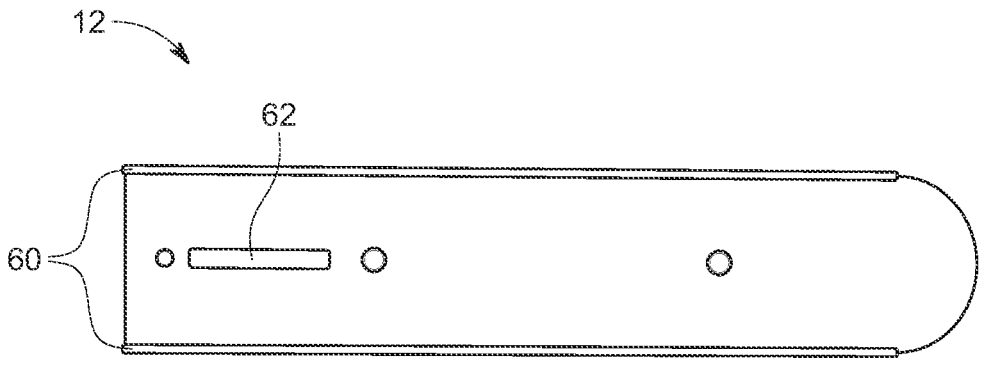
FIG. 3 is a top view of a paint applicator of the elongated painting apparatus.
Figure 4:
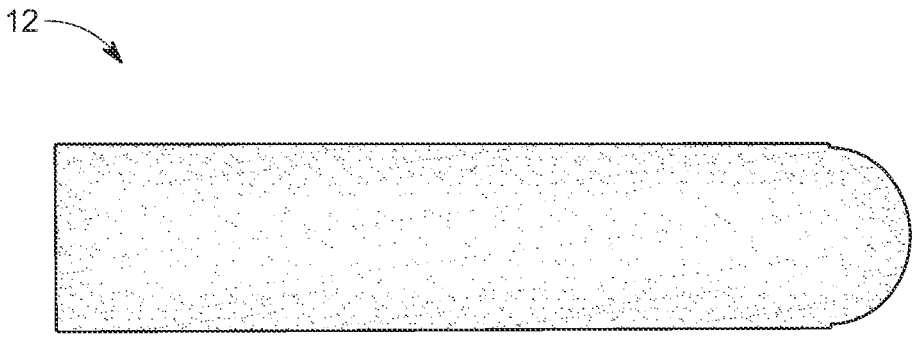
FIG. 4 is a bottom view of the paint applicator.
Figure 5:
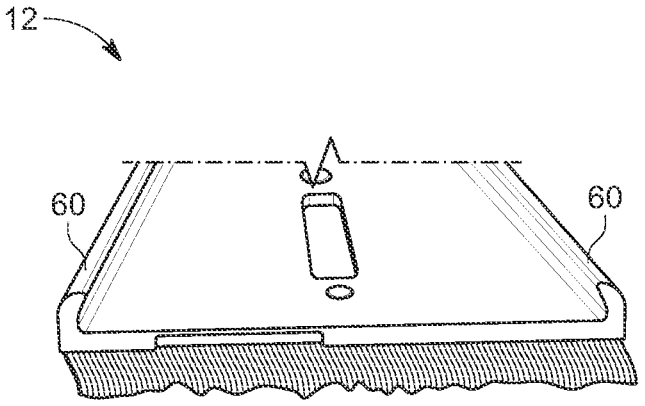
FIG. 5 is an end perspective view of the paint applicator.

The elongated painting system 10 includes a paint applicator holder 14 and a paint applicator 12 that is operably attached to the paint applicator holder 14. As illustrated in FIGS. 1 and 2, the paint applicator holder 14 includes a handle portion 20 and an applicator portion 22.

In certain embodiments, the handle portion 20 includes an elongated region configured to be grasped by a user of the elongated painting apparatus 10. The elongated region may be formed with a length, width and outer surface contour to at least partially conform to the shape of the user's hand when closed.

The handle portion 20 includes several features that enhance the ability to hold onto the handle portion 20 if part of the handle portion 20 is at least partially covered with paint, which can reduce the ability to grasp the handle portion 20.

The handle portion 20 may generally be defined as including a proximal section 40, an intermediate section 42 and a distal section 44. In certain embodiments, the proximal section 40, the intermediate section 42 and the distal section 44 may be integrally formed.

The proximal section 40 may have a maximum width and/or a maximum height that is larger than a maximum width and/or a maximum height of the intermediate section 42. Forming the proximal section 40 with the maximum width and/or the maximum height that is larger than the maximum width and/or the maximum height of the intermediate section 42 reduces the potential of the user's hand slipping off of the end of the elongated painting apparatus 10 because even if the user's hand is held slightly larger than the intermediate section 42, the user's hand will encounter the wider and/or higher proximal section 40 and thereby be prevented from sliding off the handle portion 20.

Forming the proximal section 40 with the maximum width and/or the maximum height that is larger than the maximum width and/or the maximum height of the intermediate section 42 also enables the user to sense the position of the user's hand on the handle portion 20 without the user having to view the position of the hand on the handle portion 20.

At least one of the top surface and the bottom surface of the handle portion 20 may include a non-smooth transition (not shown) between the proximal section 40 and the intermediate section 42. In certain embodiment, the non-smooth transition is a ridge on the upper surface.

The non-smooth transition enhances the ability of the user to sense the position of the user's hand on the handle portion 20 without the user having to view the position of the hand on the handle portion 20.

The intermediate section 42 may encompass up to about 80 percent of a length of the handle portion 20. In certain embodiments, the intermediate section 42 encompasses between about 40 percent and about 80 percent of the length of the handle portion 20.

The handle portion 20 may be fabricated from the same material as the other components of the elongated painting apparatus 10. Alternatively, the handle portion 20 may be fabricated from a material such as molded plastic.

The applicator portion 22 has a first surface 30 and a second surface 32 that are oriented opposite each other. In at least one embodiment, the first surface 30 is substantially flat and is adapted to receive the paint applicator material 12. It will further be appreciated that various embodiments of the applicator portion 22 are of varying lengths.

The length of the applicator portion 22 depends on the size of the object behind which the user desires to paint. In certain embodiments, the applicator portion 22 is between about 12 inches and about 18 inches. However, other embodiments may feature an applicator portion 22 as short as about 6 inches and as long as about 36 inches.

Depending on the length of the applicator portion 22 and the material from which the applicator portion 22 is formed, it may be necessary to strengthen the applicator portion 22 to ensure that an end of the applicator portion 22 that is opposite the handle portion 20 is sufficiently rigid to cause the paint to be applied to the surface.

An example of one such device that may be used to strengthen the applicator portion 22 is at least one rib 34 that extends from the second surface 32 along at least a portion of a length of the applicator portion 22.

The applicator portion 22 may be formed with a width that depends on factors such as the size of the object behind which it is desired to paint and the volume of paint that is desired to be held with the paint applicator 12. For example, the wider the paint applicator 12, the more paint that may be held in the paint applicator 12, which reduces the frequency at which the paint applicator 12 must be refilled with paint. In at least one embodiment, the width of the applicator portion 22 is about 6 inches. In alternative embodiments, the width is smaller, even as small as about 1 inch.

Proximate the intersection of the applicator portion 22 and the intermediate portion 24, a stop mechanism 36 may extend therefrom. The stop mechanism 36 limits a distance to which the paint applicator 12 may be inserted over the applicator portion 22. A person of skill in the art will appreciate that the stop mechanism 36 may assume a variety of configurations using the concepts of the invention.

The applicator portion 22 may be formed from a variety of materials using the concepts of the invention. In some embodiments, the applicator portion 22 may be formed from a metallic material such as stainless steel. Forming the applicator portion 22 from stainless steel enables the applicator portion 22 to be relatively rigid and relatively thin.

The intermediate portion 24 may offset the handle portion 20 from the applicator portion 22 such that when the applicator portion 22 is positioned along a surface for applying paint to the surface, the handle portion 20 is located above the surface such that the user's hand does not contact the surface and thereby contact the wet paint.

In some embodiments, the offset between the handle portion 20 and the applicator portion 22 is up to about 6 inches. In other embodiments, the offset between the handle portion 20 and the applicator portion 22 is between about 1 inch and about 3 inches.

The intermediate portion 24 may be oriented at an angle with respect to the applicator portion 22. In some embodiments, the angle may be between about 20 and about 90 degrees.

The handle portion 20, the applicator portion 22 and the intermediate portion 24 may be oriented in different configurations. Examples of alternative configurations provide the painting apparatus 10 with a C-shape or an L-shape.

The intermediate portion 24 may be integrally formed with at least one of the handle portion 20 and the applicator portion 22. The intermediate portion 24 may have sufficient rigidity such that when a pressure is applied to the applicator portion 24 with the handle portion 20, the intermediate portion 24 resists deformation.

The paint applicator 12 may be formed with a size and a shape that is similar to the size and shape of the applicator portion 22. A distal end of the paint applicator 12 may be curved. Extending from opposite sides on a back side of the paint applicator 12 are arms 60. These arms 60 extend partially around the applicator portion 22 to retain the paint applicator 12 on the applicator portion 22.

The elongated configuration of the paint applicator 12 minimizes the amount of paint in the paint applicator 12 to paint the surface that is at least partially behind an object that is a relatively small distance from the surface to which the paint is applied. In certain embodiments, a distance between the object and the surface to which the paint is applied is less than about five inches. In other embodiments, the distance between the object and the surface to which the paint is applied is less than about two inches. As used herein, the term elongated means that the paint applicator has a length that is at least about four times longer than a width.

The paint applicator 12 may be formed from a variety of materials using the concepts of the invention such that the paint applicator 12 is relatively thin and has the ability to absorb paint to facilitate applying the paint to the surface. In some embodiments, the paint applicator material may be foam, bristles, fabric or some combination thereof.

In some embodiments, the paint applicator 12 has a paint applicator material that is consistent over the entire surface thereof. In other embodiments, the paint applicator 12 may have at least two applicator regions that are fabricated from different materials.

The paint applicator 12 may be attached to the applicator portion 22 using a variety of techniques. In some embodiments, the paint applicator 12 is permanently attached to the applicator portion 22. Using such a configuration, the elongated painting apparatus 10 may be disposed of after use.

In other embodiments, the paint applicator 12 may be removably attached to the applicator portion 22. An example of suitable techniques for removably attaching the paint applicator 12 is an adhesive or a hook and loop fastener such as is available under the designation VELCRO.

Alternatively or additionally, a portion of the paint applicator 12 may extend over at least a portion of the applicator portion 22 such that sliding of the paint applicator 12 with respect to the applicator portion 22 facilitates attachment or detachment of the paint applicator 12 to the applicator portion 22.

In such a configuration, a lock mechanism may be provided to retain the paint applicator 12 in a desired location with respect to the applicator portion 22. The lock mechanism includes an engagement structure 38 and an opening 62. In certain embodiments, the engagement structure 38 is on the applicator portion 22 and the opening 62 is on the paint applicator 12.

The engagement structure 38 extends below a lower surface of the applicator portion 22. In certain embodiments, the engagement structure 38 has an elongated shape. In other embodiments, the engagement structure 38 may be formed with a non-elongated shape.

In certain embodiments, a height of the engagement structure 38 proximate a proximal end thereof may be greater than a height of the engagement structure 38 proximate a distal end thereof to facilitate sliding the paint applicator 12 over the engagement structure 38.

The engagement structure 38 has a top panel 50 and a proximal panel 52 at a proximal end thereof. The proximal panel 52 is oriented at an angle with respect to the top panel 50. In certain embodiments, the angle is between about 10 degrees and about 90 degrees.

The opening 62 is adapted to receive at least a portion of the engagement structure 38. In certain embodiments, the opening 62 has a length and a width that are similar to but larger than the length and the width of the engagement structure 38.

Seating of the engagement structure 38 in the opening 62 causes the paint applicator 12 to resist being separated from the applicator portion 22 such as when the painting apparatus 10 is moved along the surface of a wall to apply paint to the wall.

When it is desired to separate the paint applicator 12 from the applicator portion 22, at least one of the applicator portion 22 and the paint applicator 12 has sufficient flexibility to deflect when it is desired to remove the paint applicator 12 from the applicator portion 22 by sliding the paint applicator 12 towards the distal end of the applicator portion 22.

A person of skill in the art will appreciate that it is possible to reverse the location of the opening and the engagement structure so that the opening is formed in the applicator portion 22 and the engagement structure extends from the paint applicator 12.

Figure 6:
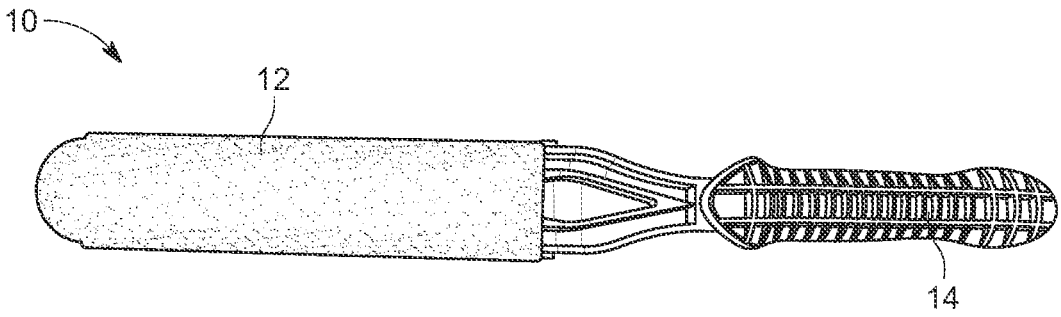
FIG. 6 is a bottom view of the paint applicator in a fully inserted position with respect to the handle portion.

In certain situations, it may be desirable for paint to be applied to a surface that is located further than can be reached when the paint applicator 12 is fully extended onto the paint applicator holder 14, as illustrated in FIG. 6. In such a situation, more than one engagement structure 38 may be provided on the applicator portion 22. The engagement structures 38 may be provided in a spaced-apart configuration.

Figure 7:
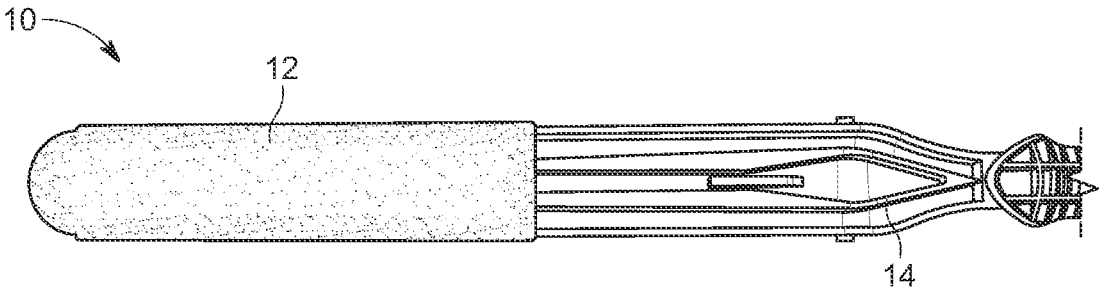
FIG. 7 is a bottom view of the paint applicator in a partially inserted position with respect to the handle portion.
Figure 8:
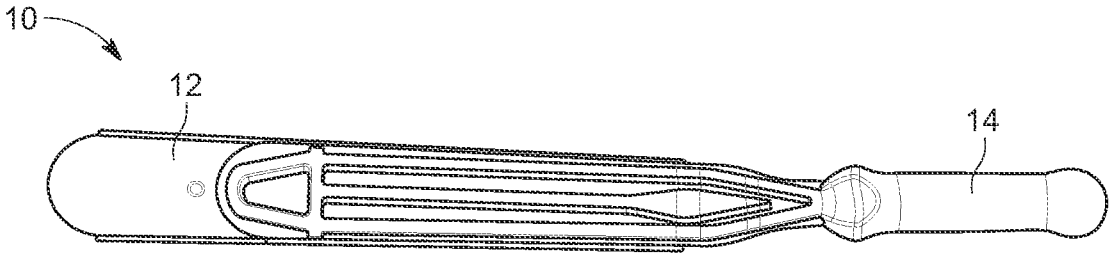
FIG. 8 is a top view of the paint applicator in the partially inserted position with respect to the handle portion.

When the paint applicator 12 is fully inserted on the paint applicator holder 14, as illustrated in FIG. 6, the opening engages the first engagement structure 38*a*. When the paint applicator 12 is partially inserted onto the paint applicator holder 14, as illustrated in FIGS. 7 and 8, the opening 62 engages the second engagement structure 38*b* that is located closer to the distal end of the applicator portion 22. Such engagement restricts the paint applicator 12 from sliding off of the applicator portion 22.

A person of skill in the art will appreciate that the concepts of the invention may be modified to utilize more than two engagement structures. Alternatively or additionally, the invention may be modified to utilize more than one opening.

When the paint applicator 12 is in the partially inserted configuration illustrated in FIGS. 7 and 8, the distal end of the paint applicator 12 may have a greater amount of flexibility as compared to when the paint applicator 12 is fully inserted onto the applicator portion 22. Such flexibility may decrease the ability of the distal end of the paint applicator 12 to make sufficient contact with the wall to cause paint to be applied to the wall.

When it is anticipated that the paint applicator 12 may be used in the partially inserted configuration, the paint applicator 12 may be formed with enhanced structural rigidity to enhance the likelihood that the distal end of the paint applicator 12 will make sufficient contact with the wall to cause paint to be applied to the wall.

Figure 9:
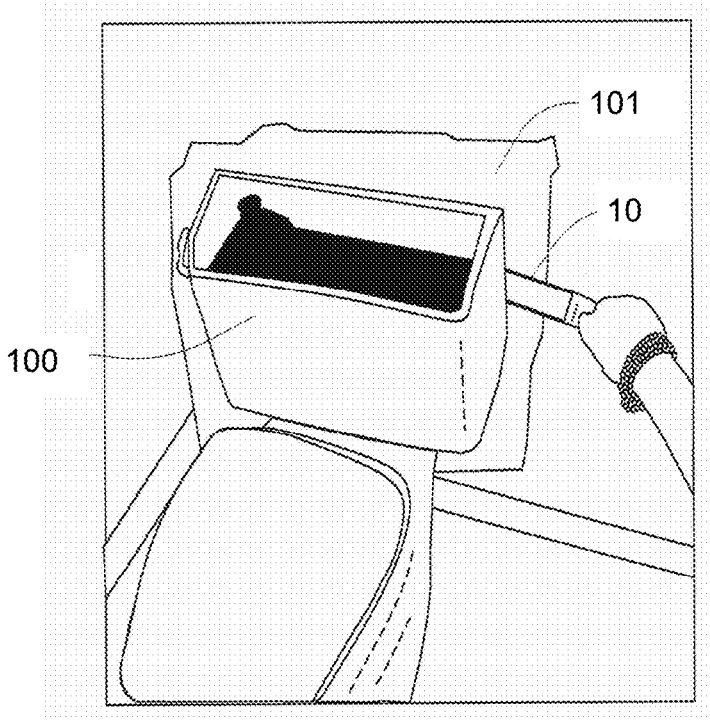
FIG. 9 is a perspective view of the elongated painting apparatus being used to paint a portion of a wall that is located behind a toilet.

FIG. 9 illustrates the use of the painting system 10 in conjunction with applying paint to a wall surface 101 that is located behind an object 100 such as a toilet, which is located relatively close to the wall surface 101 such as to make it difficult to paint the wall surface 101 behind the object 100 using a conventional paint brush or a paint roller.

In the preceding detailed description, reference is made to the accompanying drawings, which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments can be positioned in a number of different orientations, the directional terminology is used for purposes of illustration and is in no way limiting. It is to be understood that other embodiments may be utilized and structural or logical changes may be made without departing from the scope of the present invention. The preceding detailed description, therefore, is not to be taken in a limiting sense, and the scope of the present invention is defined by the appended claims.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. An elongated painting apparatus comprising:

a paint applicator holder comprising a handle portion and an applicator portion that extends from a distal end of the handle portion;

a paint applicator that is detachably engagable with the applicator portion; and a lock mechanism comprising a first engagement structure, a second engagement structure and an opening, wherein the first engagement structure and the second engagement structure are provided in one of the applicator portion and the paint applicator, wherein the opening is formed in one of the applicator portion and the paint applicator where the first engagement structure and the second engagement structure are not located, wherein the paint applicator is in a first position when the first engagement structure is received in the opening, wherein the paint applicator is in a second position when the second engagement structure is received in the opening and wherein the first engagement structure or the second engagement structure is alternatively received in the opening to retain the paint applicator in the first position or the second position with respect to the paint applicator holder.

2. The elongated painting apparatus of claim 1, wherein the first engagement structure and the second engagement structure each have an elongated shape with a length that is longer than a width.

3. The elongated painting apparatus of claim 1, wherein a height of the first engagement structure and the second engagement structure proximate a proximal end of the paint applicator holder is greater than a height of the first engagement structure and the second engagement structure proximate a distal end of the paint applicator holder.

4. The elongated painting apparatus of claim 1, wherein the first engagement structure and the second engagement structure each comprise a top panel and a proximal panel, wherein the proximal panel is oriented towards a proximal end of the paint applicator holder and wherein the proximal panel is oriented at an angle with respect to the top panel.

5. The elongated painting apparatus of claim 1, wherein the applicator portion is offset from the handle portion.

6. The elongated painting apparatus of claim 1, wherein the applicator portion comprises a reinforcing rib extending from a surface thereof.

7. The elongated painting apparatus of claim 1, and further comprising a stop mechanism that extends from the paint applicator holder to limit a distance that the paint applicator is insertable over the paint applicator holder.

8. The elongated painting apparatus of claim 1, wherein the paint applicator comprises:

a base having a first side and a second side;

a paint applicator material attached to the first side; and a pair of arms extending from the second side, wherein the arms extend partially around the paint applicator holder to retain the paint applicator on the applicator portion.

9. The elongated painting apparatus of claim 1, wherein a length of the paint applicator is at least four times greater than a width of the paint applicator.

10. A method of painting a surface having an object in close proximity thereto, wherein the method comprising:

providing an elongated painting apparatus comprising a paint applicator holder, a paint applicator and a lock mechanism, wherein the paint applicator holder comprises a handle portion and an applicator portion that extends from a distal end of the handle portion, wherein the lock mechanism comprising a first engagement structure, a second engagement structure and an opening, wherein the first engagement structure and the second engagement structure are provided in one of the applicator portion and the paint applicator, wherein the opening is formed in one of the applicator portion and the paint applicator where the first engagement structure and the second engagement structure are not located;

positioning the paint applicator in a first position with respect to the paint applicator holder where the first engagement structure is at least partially received in the opening, wherein the elongated painting apparatus has a first length when the paint applicator is in the first position;

applying paint to at least a portion of the paint applicator;

with the paint applicator in the first position, placing the portion of the paint applicator to which the paint has been applied in contact with the surface to apply the paint to the surface a first distance behind the object;

moving the paint applicator to a second position with respect to the paint applicator holder where the second engagement structure is at least partially received in the opening, wherein the elongated painting apparatus has a second length when the paint applicator is in the second position and wherein the first length is different than the second length; and with the paint applicator in the second position, placing the portion of the paint applicator to which the paint has been applied in contact with the surface to apply paint to the surface a second distance behind the object, wherein the first distance is different than the second distance.

11. The method of claim 10, wherein at least one of the paint applicator and the paint applicator holder deflects when the paint applicator is moved from the first position to the second position.

12. The method of claim 10, wherein the first engagement structure and the second engagement structure each have an elongated shape with a length that is longer than a width.

13. The method of claim 10, wherein a height of the first engagement structure and the second engagement structure proximate a proximal end of the paint applicator holder is greater than a height of the first engagement structure and the second engagement structure proximate a distal end of the paint applicator holder.

14. The method of claim 10, wherein the first engagement structure and the second engagement structure each comprise a top panel and a proximal panel, wherein the proximal panel is oriented towards a proximal end of the paint applicator holder and wherein the proximal panel is oriented at an angle with respect to the top panel.

15. The method of claim 10, wherein a length of the paint applicator is at least four times greater than a width of the paint applicator.

* * * * *